US005259116A

United States Patent [19]

Laube

[11] Patent Number: 5,259,116

[45] Date of Patent: Nov. 9, 1993

[54] ANIMAL GROOMING CLIPPER

[76] Inventor: Kim Laube, 15041 Broadmoor St., Sepulveda, Calif. 91343

[21] Appl. No.: 877,529

[22] Filed: May 1, 1992

Related U.S. Application Data

[63] Continuation-in-part of Ser. No. 716,316, Jun. 17, 1991, abandoned.

[51] Int. Cl.[5] ..... B26B 19/02

[52] U.S. Cl. ..... 30/216; 30/215; 30/209; 30/DIG. 1

[58] Field of Search ..... 30/43.92, 45, 34.1, 30/216, 219, DIG. 1, DIG. 2, 210, 206, 215

[56] References Cited

U.S. PATENT DOCUMENTS

| | | | |
|---|---|---|---|
| 3,359,635 | 12/1967 | Jepson et al. | 30/43.92 |
| 4,133,733 | 11/1980 | Gallanis et al. | 30/43.92 |
| 4,592,142 | 6/1986 | Schnizler | 30/210 |
| 4,631,825 | 12/1986 | Kuriyama et al. | 30/43.92 |
| 4,813,133 | 3/1989 | Locke et al. | 30/43.92 |
| 4,813,136 | 3/1989 | Pibes et al. | 30/43.92 |
| 4,845,847 | 7/1989 | Yasunaka et al. | 30/43.92 |
| 4,918,819 | 4/1990 | Labrijn | 30/DIG. 1 |

*Primary Examiner*—Douglas D. Watts
*Assistant Examiner*—Hwei-Siu Payer
*Attorney, Agent, or Firm*—Law Offices of Beech & Collins

[57] ABSTRACT

The hair grooming clipper is driven by an improved eccentric coupling to a motor housed in the handle. The motor is incorporated in the clipper casing and utilizes an improved eccentric coupling that results in more power to the clipper head and less wear in the coupling. The improved design delivers more power to the clipper head, generating less heat.

7 Claims, 2 Drawing Sheets

ANIMAL GROOMING CLIPPER

CROSS REFERENCES TO RELATED APPLICATIONS

This is a continuation-in-part of application Ser. No. 07/716,316, filed Jun. 17, 1991, now abandoned.

this prior application is abandoned with claims 1 through 8 rejected.

FIELD OF THE INVENTION

This invention relates to clipper devices and more particularly to animal grooming clippers.

BACKGROUND OF THE INVENTION

Most conventional clippers for grooming animals incorporate an electric motor within a casing for driving the clipper blades. These blades constitute a clipper blade assembly wherein there are provided stationary blade teeth and movable blade teeth, the movable blade teeth having a small receiving cavity for a finger which oscillates back and forth and results in relative movement between the blades. Such a blade assembly can be housed in an appropriate clipper blade assembly holder provided as part of the casing itself. The manner of attaching and detaching such blade assemblies to a clipper in a proper position such that a driving finger can be received in an appropriate cavity to drive the movable clipper blade teeth is well known in the art. Usually, the rotation of the motor shaft in the casing is converted into an oscillating motion of the drive finger to drive the blades.

As a consequence of the foregoing configuration, the clipper after prolonged use can become heated not only as a consequence of the presence of the motor itself in the casing, but also because of heat developed in the driving of the gear train and eccentric coupling to oscillate the blades. In order to resist the developed heat, clippers have specially designed plastic casing material which is heat resistant. Although other clipper patents include eccentric couplers or rounded couplers such as U.S. Pat. Nos. 4,813,133 and 4,233,733 they do not include a receiving or mating cavity shaped to accept a rounded drive disc nor do they allow axial movement of the coupler means.

In order to minimize the foregoing disadvantages, the motor carried within the clipper casing has been made as small and as light as is practical. A battery pack easily detached and reinsertable provides independence from power cords or cables. Moreover, after prolonged use, the mechanism for converting the rotary motion of the motor to the oscillating motion required to drive the cutter blades becomes worn and as a result the overall amplitude of the oscillation of the cutting teeth decreases. Such decrease in amplitude even though slight substantially reduces the efficiency of the cutting action. The distortion caused by wear in coupling is greatly reduced by having a coupling that allows angular and axial movement. The resulting clipper blade motion from an approximately rounded coupling that allows engagement of more surface area in the coupling and axial movements of the coupling means results in a modified cutter blade stroke that cuts more evenly.

SUMMARY OF THE INVENTION

With all the foregoing considerations in mind, the present invention contemplates the provision of an improved animal grooming clipper overcoming the various problems associated with the prior art clippers described above.

More particularly, in accord with the present invention there is provided a casing for holding a clipper blade assembly, a connection of the motor to the casing, a battery pack and a coupling that provides substantially constant oscillation and improved blade cutting stroke even under heavy loads. Other objectives of the intended invention will become apparent when the description and drawings herein contained are reviewed.

DESCRIPTION OF THE PREFERRED EMBODIMENT

Figure 1:
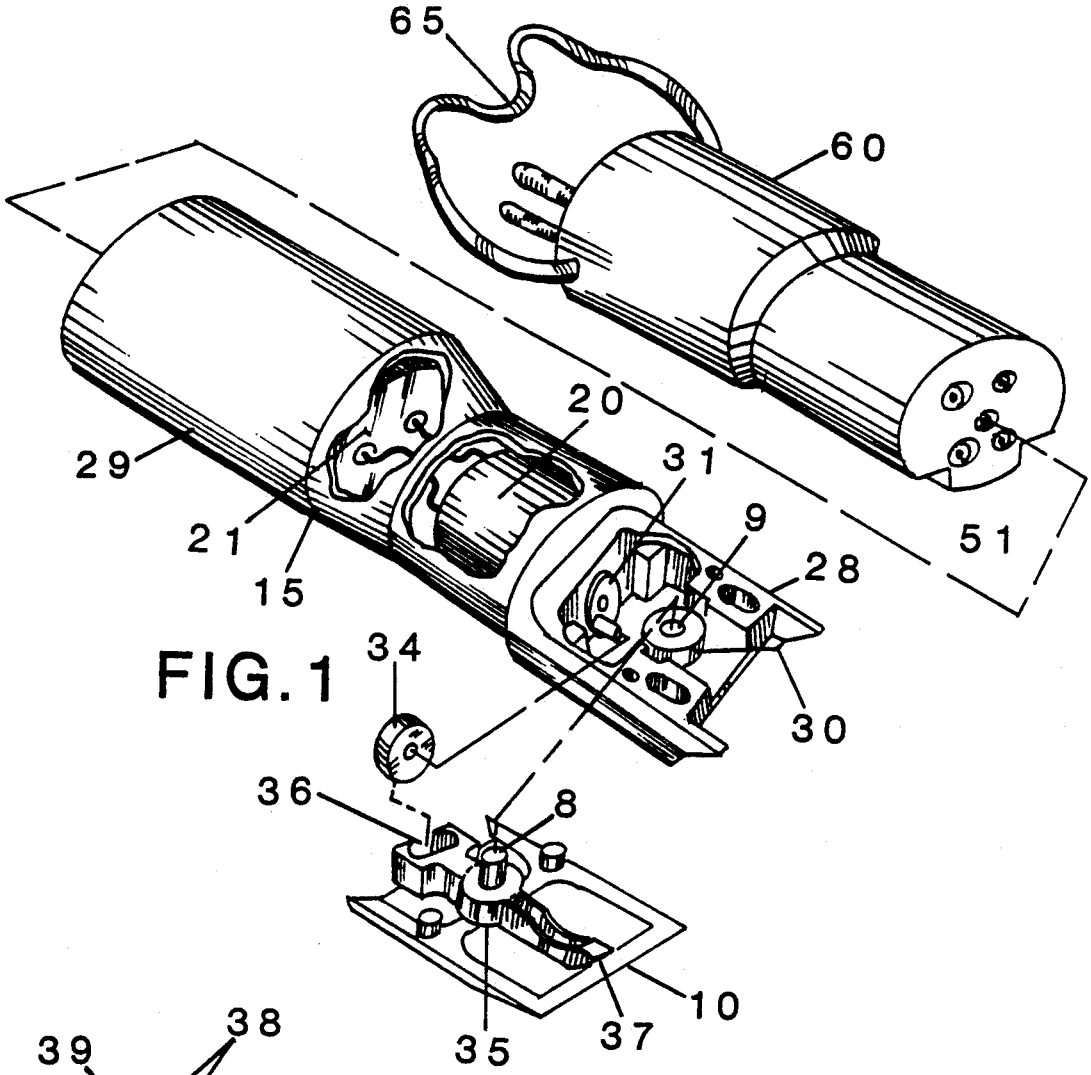
FIG. 1 illustrates an exploded perspective view of the casing portion of the grooming clipper.

Referring to FIG. 1, the improved clipper includes an elongated clipper casing (15) that is easily held with one hand. This casing includes a clipper blade assembly (16) illustrated in FIGS. 2 through 3. The rear end of the casing (15) includes a motor shaft (20) and quick charge battery pack (60).

With the foregoing arrangement, the clipper casing (15) itself can be maintained and is easily maneuverable since the entire unit is self-contained.

Referring to FIG. 1, details of the casing for the clipper without the clipper blade assembly (16) and inner portions thereof will be described. The upper half of the casing is shown exploded above the remaining portion to expose the interior. The front and rear ends of the casing (15) are indicated at (28) and (29) respectively, the clipper blade assembly holder is shown at (30) for holding the clipper blade assembly (16).

Referring first to the central portion of FIG. 1, the casing includes a quick charge battery pack (60) extending axial along the axis of the casing. The quick charge battery pack (60) consists of eight batteries and connects to the rear of the motor (20). A circuit board (21) connects the battery terminal to the motor (20). The motor (20) is attached to the casing by an attachment means such as bolts (44). The rear end of the motor shaft (31) is part of the motor gear assembly.

Figure 8:
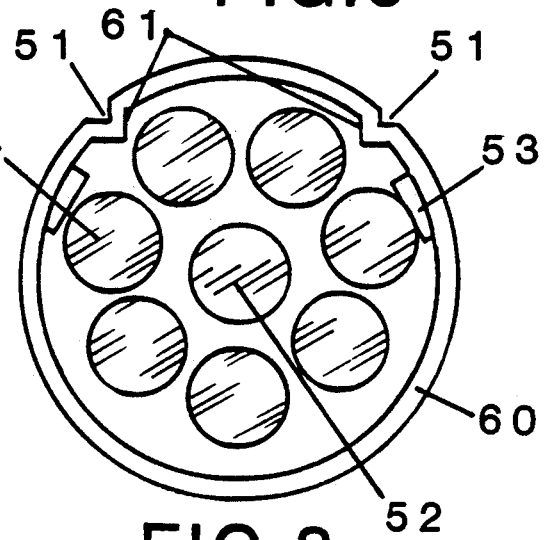
FIG. 8 illustrates a top view of the battery pack assembly.
Figure 7:
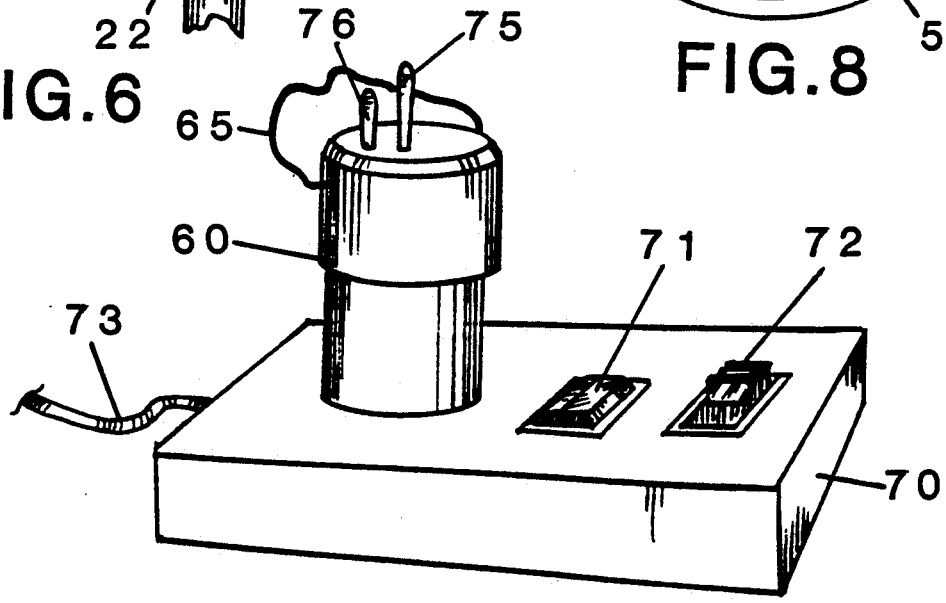
FIG. 7 illustrates a top perspective view of the battery charging assembly.

As shown in FIG. 1 and FIG. 8, the quick charge battery pack (60) has eight batteries. Seven AA size batteries (54) are circumferentially placed around a single AA (52) battery in the center. Two guides (61) on each side of the quick charge battery pack (60) formed by the slots (51) are placed longitudinally to align the batteries in the battery pack (60). The slots (51) also serve to align the battery pack (60) in the casing (15). Raised portions (53) along the inner circumference of the quick charge battery pack (60) and placed between the seven batteries (54) further keep the batteries firmly in place.

As shown in the forward end portion of the casing (15) there is provided a lever element (35) pivoted intermediate its ends for oscillating movement about a lever element shaft (8) normal to the axis of the motor shaft (31). The rear end of this lever element terminates in a cavity (36) receiving the eccentric disc (34) mounted on the off center shaft (32) of the motor shaft (31) so that rotation of the shaft (31) will result in the eccentric disc (34) bearing against the opposed walls of the cavity (36) to effect an oscillating movement of the lever element (35) by the eccentric disc (34). The cavity is shaped to accept the circular shaped eccentric disc (34). The receiving sides of the eccentric disc (34) are rounded to assure that when the drive finger (37) oscillates to one side and the other the eccentric disc (34) sides provide a surface sufficient to prevent wearing of either the eccentric disc (34) or receiving cavity (36). A bushing (45) is used to attach the eccentric disc (34) to the motor shaft (31) to allow the eccentric disc (34) to rotate if necessary. The bushing (45) allows movement along the axis of the off center shaft (32) as the motor shaft (31) rotates.

Figure 4:
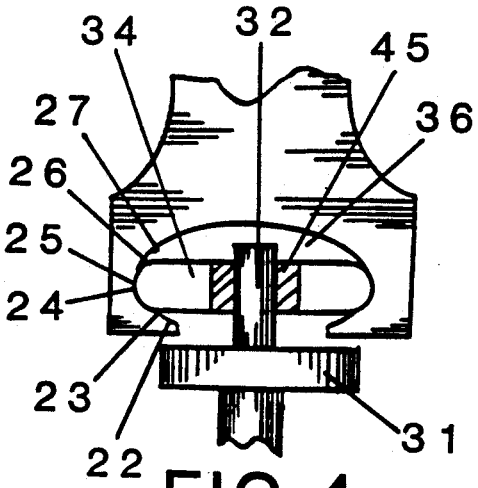
FIG. 4 illustrates a top sectional view of the coupling in the mid position.
Figure 5:
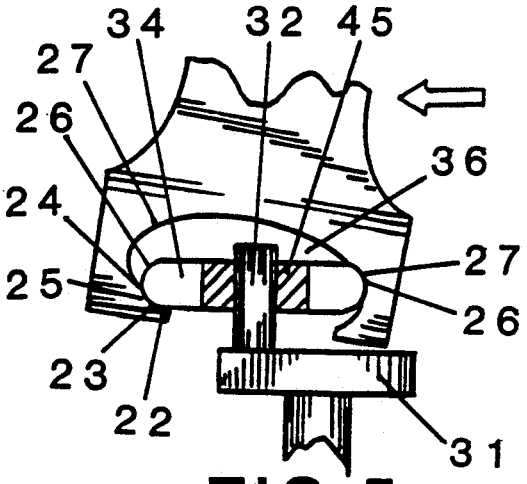
FIG. 5 illustrates a top sectional view of the coupling in the left position.
Figure 6:
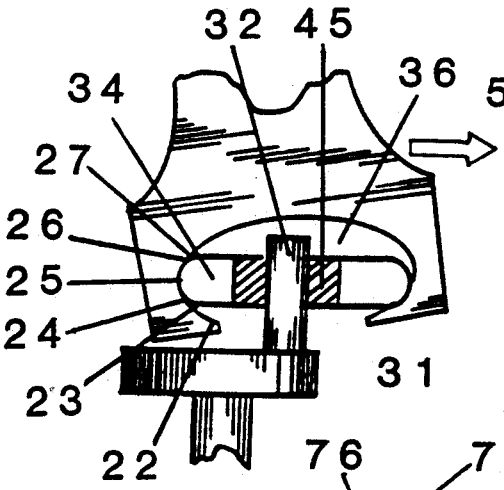
FIG. 6 illustrates a top sectional view of the coupling in the right position.

Whereas the blades of prior art devices oscillate in typically a horizontal manner, the improved clipper has a change in oscillation speed at the end of the finger stroke. The change in speed occurs when the shaped bearing surface of the eccentric disc (34) engages the receiving cavity (36) as the finger moves outward and is engaged by the end of the eccentric disc (34). The bushing (45) is selected to substantially reduce friction and in combination with the rounded receiving cavity (36) eliminates the wear and heat generated as compared to other designs. As further illustrations in FIGS. 2 through (6) the eccentric disc is shown in various positions when the eccentric disc (34) is in the center position, FIGS. 2 and 4, the center position of the rounded disc edge center (25) engages the receiving cavity midwall (24). As the motor shaft (31) is driven to the left the point of contact of maximum pressure changes as the mid portion of the eccentric disc (34) motor side edge (23) engages the receiving cavity (36) surface at the bottom wall (22). The eccentric disc (34) surface near the motor at the motor side edge (23) also moves towards the receiving cavity (36) surface near the motor at the bottom wall (22). When the eccentric disc (34) is as shown in FIG. (5) and the motor shaft (31) causes the eccentric disc (34) to engage the right side of the receiver cavity (36) at the top wall (27) as it returns then the lever element side edge (26) of the eccentric disc (34) engages the receiving cavity (36) at a point away from the motor at the top wall (27). Throughout the cycle the eccentric disc (34) is free to move axially to engage the shaped receiving cavity (36) sides. By shaping the sides of the receiving cavity (36) the point of contact can be altered to change the motion of the receiving cavity (36) and thereby changing the speed of the movable blade teeth (39). Although the preferred embodiment uses near circular mating surfaces other designs are feasible. For example, more oblong eccentric disc (34) sides may be used as a shape.

Figure 2:
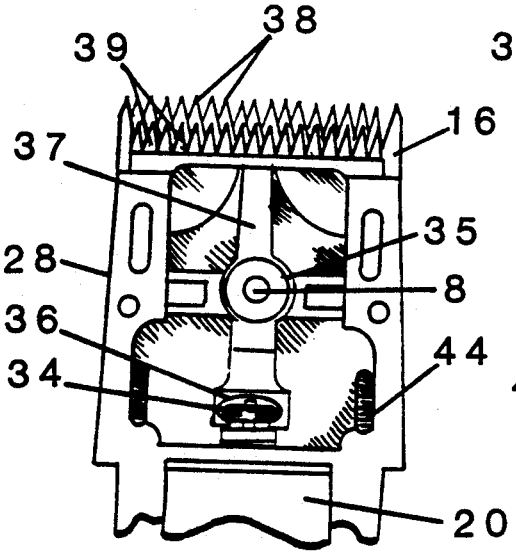
FIG. 2 illustrates a fragmentary top plan view showing the position of various components when the blades are in a central position.
Figure 3:
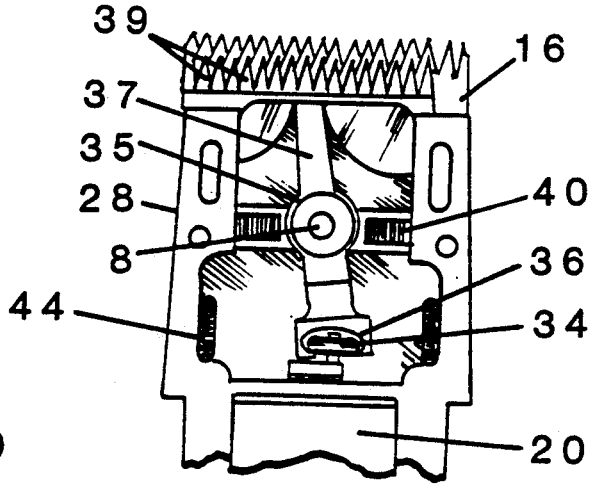
FIG. 3 illustrates a view similar to FIG. 2 but illustrating the position of components when the blades are in the side position.

The forward end of the lever element (35) as shown in FIGS. 2 and 3 terminates in a drive finger (37) receivable in the clipper blade assembly (16) when the clipper blade assembly (16) is positioned in the clipper blade assembly holder (30). This drive finger (37) will move back and forth as a consequence of the above-described oscillation of the lever (35) to operate the clipper assembly (16). As typical of all prior art clipper assemblies, the clipper assembly (16) includes stationary blade teeth (38) and movable blade teeth (39). The improved movement of the finger (37) back and forth will cause the movable blade teeth (39) to oscillate back and forth relative to the stationary blade teeth (38) providing the desired shearing or cutting action of the clipper blades. By shaping the circumference of the eccentric disc (34) different types of strokes can be created. The effect of the shape of the rounded eccentric disc (34) is to manipulate the timing and resulting motion of the movable blade teeth (39) on the clipper blade assembly (16). The pattern allows the hair to be trimmed more uniformly by feeding the hair smoothly and uniformly into the movable blade teeth (39) and stationary blade teeth (38). Small opposed felt-like pads (40) on either side of the central portion of the level element (35) will prevent hairs and the like from passing backwardly into the main portion of the casing. The main portion of the casing behind the felt-like pads (40) may be filled with appropriate lubricant.

The improved basic clipper includes the lever element shaft (8) being supported at both the upper and the lower end of the lever element shaft (8). The lever element shaft (8) in the preferred embodiments is fixed to the cover (10) and snaps tightly into a lever receiving element slot (9).

Referring now to FIGS. 2 to 6, the operation of the lever element (35) for converting rotary motion of the shaft (31) to oscillating motion for operating the movable blades of the clipper blade assembly as described in FIG. 1 will be better understood.

In FIG. 2, the eccentric disc (34) is shown in an upwardly extending position from the end of the shaft (31). In this position, the movable blade teeth (39) are in a central position relative to the stationary blade teeth (38) and the lever element (35) is in alignment with the axis of the motor shaft (31).

Referring now to FIG. 3, the relative positions of the various components described in FIG. 2 are shown after the shaft (31) has made a quarter turn in a clockwise direction as viewed in FIG. 3. Thus, this quarter turn will position the eccentric disc (34) to the right as viewed in FIG. 3, camming the rear end of the lever element (35) to the right so that the forward finger portion thereof will drive the movable blade teeth (39) to the left; that is, to one side as indicated in FIG. 3. The rounded edges of the eccentric disc (34) moving against the lever element (35) provides a sufficient surface to prevent the tendency for excess wear and noise caused by the squared edges of other non-rounded coupling. The reduced noise and vibration is especially significant for dealing with animals with sensitive hearing and sensitivity to conventional clippers.

After a further quarter turn to bring the eccentric disc (34) into a downwardly extending position, the movable blade teeth (39) will be moved back to a central position as indicated in FIG. 2 and a further quarter turn which will position the eccentric disc (34) to the left will then cause the movable blade teeth (39) to assume their right-hand-most position. As in the left hand position the rounded edges of the eccentric disc (34) provides a sufficient surface to minimize wear, noise and vibration.

The relative positions of the components illustrated in FIGS. 2 through 6 wherein it will be evident that as the rear portion of the lever element (35) is moved to the right, such as viewed in FIG. 3, the drive finger (37) will move to the left to drive the movable blade teeth (39) to the one side position described.

In both FIGS. 2 and 3, it will be evident that the felt-like pads (40) on either side of the central portion of the lever element (35) will isolate the inner portion of the casing from the front area exposed to the blades and thus will block hairs or other debris from passing back into the mechanism. There may be provided a lubrication medium such as grease indicated at (44) in FIGS. 2 and 3 to minimize friction and wear of the eccentric disc (34) within the receiving cavity (36) of the lever element (35).

Because of the greater useable horsepower available by use of the rounded coupling, the amplitude of oscillation of the movable blades relative to the stationary blades can be made greater than in the case where the coupling is not rotatable and rounded. Because of the available power, the frequency of the oscillation can be maintained substantially constant even under heavy loading. The shape of the actual cutting stroke can be adjusted to different cutting strokes by adjusting the rounded point on the eccentric disc (34) rounded sides.

Referring to FIG. (7), the quick charge battery pack assembly charger (70) includes indicator (71), charger power switch (72) and a power cord (73). In the preferred embodiment two switches are located in the rear of the quick charge battery pack (60). The location of the power switch at the rear provides the advantage of easy operation while placing the clipper power switch (75) away from the forward surface where they may be conducting operations. The clipper power switch (75) and speed control switch (76) turns the groomer on and off and provides two levels of cutter speed. Variable speed options can be easily adapted to the preferred embodiment. By using the quick charge battery pack (60) assembly, great flexibility and independence is obtained. A quick charge battery pack assembly charger (70) that accepts the complete quick charge battery pack (60) provides ease of recharging the batteries.

Attached to the quick charge battery pack (60) assembly is a handle (65). The handle (65) is shaped to provide a handle to withdraw the battery pack (60) assembly from the groomer, serve as a storage aid, prevent the groomer from rolling on an inclined flat surface when the groomer is placed on the surface.

From all of the foregoing, it will now be evident that the present invention has provided a greatly improved animal grooming clipper exhibiting various advantages and avoiding the many problems associated with prior art clippers.

I claim:

1. An improved clipper for grooming an animal said improved clipper comprising:

a) an electric drive motor having an axially positioned motor shaft;

b) an elongated clipper casing having front and rear ends and dimensioned intermediate its ends to be easily held with one hand;

c) a clipper blade assembly holder at the front end of said casing for holding a clipper blade assembly comprised of stationary blade teeth and movable blade teeth;

d) a lever element pivoted intermediate its ends in the forward portion of said casing for oscillating movement about an axis normal to the axis of the motor shaft, the rear end of said lever element terminating in a cavity receiving an eccentric disc which is attached to a motor shaft having an off center shaft, and said off center shaft attached in an off center eccentric manner such that rotation of said motor shaft will result in oscillating movement of said lever element by said eccentric disc, wherein said eccentric disc has rounded sides from front to back and is free to move axially along the off center shaft of such motor shaft and said cavity receives said rounded sides of said eccentric disc and retains said eccentric disc and said cavity having surfaces that are rounded to contact the rounded sides radially of said eccentric disc toward said lever element and the side of said eccentric disc toward said motor shaft as said lever element oscillates, and the forward end of said lever element terminating in a drive finger receivable in said clipper blade assembly when positioned in said clipper blade assembly holder to oscillate said movable blade teeth of said clipper blade assembly relative to said stationary blade teeth; and e) a battery pack and a battery pack interconnection means to provide power to said electric drive motor that drives said axially positioned motor shaft and that is self contained and inserted into the rearward portion of said elongated clipper casing.

2. An improved clipper according to claim 1 in which the battery pack interconnection means allows manual removal of the battery pack and insertion of the battery pack into a separate stand alone battery charger.

3. An improved clipper according to claim 1, in which said casing is made of a plastic material which is heat resistant.

4. An improved clipper according to claim 1 in which the batteries are housed in a battery pack that has longitudinal guides axially placed on the inner circumference of the battery pack to position and guide the batteries.

5. The improved clipper of claim 1 wherein a handle is also included and attached on opposite sides of the clipper.

6. An improved clipper for grooming an animal said improved clipper comprising:

(a) an electric drive motor having an axially positioned motor shaft;

(b) an elongated clipper casing having front and rear ends and dimensioned intermediate its ends to be easily held with one hand;

(c) a clipper blade assembly holder at the front end of said casing for holding a clipper blade assembly comprised of stationary blade teeth and movable blade teeth;

(d) a lever element pivoted intermediate its ends in the forward portion of said casing for oscillating movement about an axis normal to the axis of said motor shaft, the rear end of said lever element terminating in a cavity receiving an eccentric disc which is attached to said motor shaft in an off center eccentric manner such that rotation of said motor shaft will result in oscillating movement of said lever element by said eccentric disc, wherein said eccentric disc has shaped sides and is free to move axially along said motor shaft axis, and said cavity receives the shaped sides of said eccentric disc and retains said eccentric disc and said cavity having surfaces that are shaped to contact shaped sides radially of the eccentric disc toward the lever element and the side of the eccentric disc toward the motor shaft as said lever element oscillates, and the forward end of said lever element terminating in a drive finger receivable in the clipper blade assembly when positioned in the clipper blade assembly holder to oscillate the movable blade teeth of the clipper blade assembly relative to the stationary blade teeth.

7. The improved clipper in claim 5 wherein a handle is also included and located on opposite sides of the clipper.

* * * * *